US006889657B2

(12) United States Patent
Ruesseler et al.

(10) Patent No.: US 6,889,657 B2
(45) Date of Patent: May 10, 2005

(54) FUEL INJECTION DEVICE FOR AN INTERNAL COMBUSTION ENGINE

(75) Inventors: Karl-Friedrich Ruesseler, Renningen (DE); Ulrich Maier, Reutlingen (DE); Achim Koehler, Ditzingen (DE); Sascha Ambrock, Gerlingen (DE); Peter Bauer, Korntal Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 44 days.

(21) Appl. No.: 10/406,257

(22) Filed: Apr. 4, 2003

(65) Prior Publication Data

US 2003/0234000 A1 Dec. 25, 2003

(30) Foreign Application Priority Data

Apr. 5, 2002 (DE) ..... 1 02 15 021

(51) Int. Cl.[7] ..... F02M 33/02
(52) U.S. Cl. ..... 123/446; 123/506; 123/496
(58) Field of Search ..... 123/446, 447, 123/506, 496

(56) References Cited

U.S. PATENT DOCUMENTS 5,094,216 A * 3/1992 Miyaki et al. ..... 123/506
5,911,208 A * 6/1999 Furusawa et al. ..... 123/506
6,095,118 A * 8/2000 Klinger et al. ..... 123/446
6,102,010 A * 8/2000 Isozumi et al. ..... 123/506
6,135,090 A * 10/2000 Kawachi et al. ..... 123/446
6,237,573 B1 * 5/2001 Onishi et al. ..... 123/506
6,546,918 B2 * 4/2003 Onishi et al. ..... 123/506
6,694,952 B1 * 2/2004 Yamazaki et al. ..... 123/496

* cited by examiner

*Primary Examiner*—Thomas Moulis
(74) *Attorney, Agent, or Firm*—Ronald E. Greigg

(57) ABSTRACT

The fuel injection device has a high-pressure pump (14) that supplies fuel to a reservoir and is connected to injectors disposed in the cylinders of the engine. A fuel-supply pump delivers fuel from a fuel tank to the suction side of the high-pressure pump. An electrically actuated control valve adjusts the quantity of fuel that the high-pressure pump delivers to the reservoir. The control valve is disposed on the pressure side of the high-pressure pump and can be switched between a first position, in which the pressure side of the high-pressure pump is closed off from a pressure relief region, and a second position, in which the pressure side of the high-pressure pump is connected to the pressure relief region.

14 Claims, 7 Drawing Sheets

FUEL INJECTION DEVICE FOR AN INTERNAL COMBUSTION ENGINE

BACKGROUND OF THE INVENTION

1. Field of the Invention

The invention is directed to an improved fuel injection device for an internal combustion engine.

2. Description of the Prior Art

A fuel injection device known from the literature, for example *Dieselmotor-Management,* Verlag Vieweg, $2^{nd}$ ed. 1998, pp. 280 to 284, has a high-pressure pump, which supplies fuel to a reservoir connected to injectors disposed in the cylinders of the internal combustion engine. A fuel-supply pump is provided, which supplies fuel from a fuel tank to the suction side of the high-pressure pump. An electrically actuated control valve is also provided in order to adjust the fuel quantity that the high-pressure pump delivers to the reservoir. The control valve here is embodied in the form of a flow control valve, which adjusts a flow cross section in the connection of the fuel-supply pump to the suction side of the high-pressure pump. The control valve is disposed in the connection of the fuel-supply pump to the suction side of the high-pressure pump and adjusts the flow of fuel from the fuel-supply pump to the suction side of the high-pressure pump. In this instance, it is disadvantageous that the precision of the adjustment of the fuel quantity that the high-pressure pump supplies to the reservoir depends on the uniformity of the pressure generated by the fuel-supply pump and on the precise adjustment of the flow cross section by means of the control valve. Pressure pulsations generated by the fuel-supply pump and dispersions in the adjustment of the flow cross section result in fluctuations in the quantity of fuel delivered by the high-pressure pump. In addition, difficulties can arise if it is necessary for the high-pressure pump to deliver no fuel to the reservoir since this requires the control valve to completely close the flow cross section, which requires a complex design of the control valve. Alternatively, additional means must be provided in order, when the control valve has not completely closed the flow cross section, to divert fuel that is still flowing to the high-pressure pump away from it so that the high-pressure pump does not deliver this fuel.

OBJECT AND SUMMARY OF THE INVENTION

The fuel injection device according to the invention has the advantage over the prior art that the fuel quantity which the high-pressure pump delivers to the reservoir can be adjusted by means of the control valve in a highly precise, simple fashion. The invention makes it easily possible for the high-pressure pump to deliver no fuel to the reservoir by virtue of bringing the control valve into its second switched position so that the entire quantity of fuel delivered by the high-pressure pump travels into the low-pressure region.

Advantageous embodiments and modifications of the fuel injection device according to the invention are also disclosed. For example, one embodiment permits a simple design of the control valve, while another permits a temporary connection between the high-pressure pump and the reservoir with a correspondingly low dead volume. Other embodiments to permit a fuel delivery to the reservoir even in the event of a control valve malfunction in which the control valve remains continuously inactive. One embodiment reduces the requirements as to the leakproofness of the control valve.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
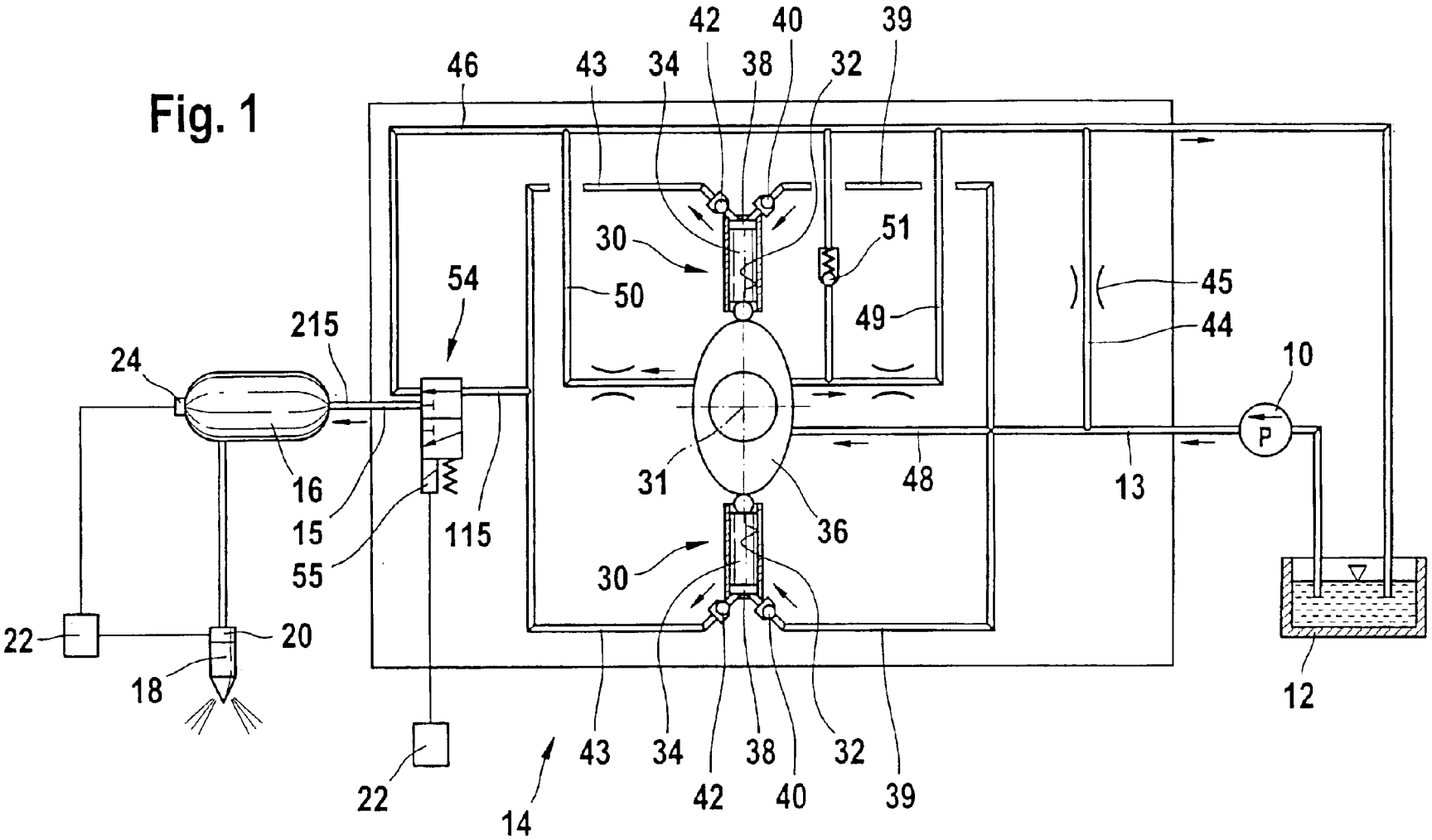
FIG. 1 shows a schematic depiction of a fuel injection device for an internal combustion engine according to a first exemplary embodiment of the invention.

FIGS. 1 to 7 show a fuel injection device for an internal combustion engine of a motor vehicle. Preferably, the engine is an autoignition engine and has a number of cylinders. The fuel injection device has a fuel-supply pump 10, which delivers fuel from a tank 12, via a connection 13, to the suction side of a high-pressure pump 14. The high-pressure pump 14 delivers highly pressurized fuel via a connection 15 to a reservoir 16. The reservoir is connected by means of hydraulic lines to injectors 18 disposed in the cylinders of the engine. In each injector 18, a control valve 20 is provided, which can open the injector 18 to produce a fuel injection and can close it to terminate a fuel injection. The control valves 20 of the injectors 18 are connected to an electronic control unit 22, which triggers them as a function of operating parameters of the engine. The reservoir 16 is provided with a pressure sensor 24, which detects the pressure in the reservoir 16. This pressure sensor is connected to the control unit 22 and supplies it with a signal for the pressure prevailing in the reservoir 16.

The high-pressure pump 14 has at least one pump element 30 with a pump piston 34 guided in a cylinder bore 32 in a sealed fashion. In the exemplary embodiment shown in FIG. 1, two pump elements 30 are provided, which are disposed on diametrically opposite sides in relation to a common axis 31. The pump pistons 34 of the pump elements 30 are set into a stroke motion by means of a shared drive unit 36, which is disposed between the pump elements 30 in the vicinity of the axis 31; the drive unit 36 can, for example, be a cam drive unit or an eccentric drive unit. Each of the pump pistons 34 defines a pump working chamber 38 in the respective cylinder bore 32, in its region oriented away from the drive unit 36. Each of the pump working chambers 38 is fed by a respective supply line 39 extending from the connection 13 with the fuel-supply pump 10, through a respective inlet valve 40, which opens toward the pump working chamber 38. In addition, through a respective outlet valve 42, a pressure line 43 leads to the connection with the reservoir 16; the outlet valve 42 opens toward the reservoir 16. When the pump pistons 34 move radially inward, they draw fuel into the pump working chambers 38 via the open inlet valves 40, while the outlet valves 42 remain closed. When the pump pistons 34 move radially outward, they deliver highly pressurized fuel through the open outlet valves 42 into the pressure lines 43, while the inlet valves 38 remain closed.

Upstream of the supply lines 39, a bypass line 44 with a throttle restriction 45 branches off from the connection 13 of the fuel-supply pump 10 to the suction side of the high-pressure pump 14 and feeds into a return 46 that leads to the fuel tank 12. The bypass line makes it possible to ventilate the connection 13 of the fuel-supply pump 10 to the high-pressure pump 14. It is also possible for a lubrication connection 48 to be provided, which leads to the drive unit 36 from the connection 13 of the fuel-supply pump 10 to the high-pressure pump 14 in order to supply fuel to the drive unit 36 for lubrication purposes. Pressure relief connections 49, 50 lead from the drive unit 36, each of which can contain a throttle restriction, and feed into the return 46. One pressure relief connection 49 can contain a pressure relief valve 51, which opens toward the return 46.

An electrically actuated control valve 54 is disposed in the connection 15 of the high-pressure pump 14 to the reservoir 16. In the first exemplary embodiment depicted in FIG. 1, the control valve 54 is embodied as a 3/2-way valve and is triggered by the control unit 22. The control valve 54 has an actuator 55, which can be an electromagnet, for example. The control valve 54 has three connections, a first connection being a part 115 of the connection 15 from the high-pressure pump 14, a second connection being a part 215 of the connection 15 toward the reservoir 16, and a third connection being the return 46. The control valve 54 can be switched between two switched positions; in a first switched position of the control valve 54, it connects the parts 115 and 215 of the connection 15 to the reservoir 16 to each other, whereas the part 115 of the connection 15 is closed off from the return 46, and in a second switched position of the control valve 54, it connects the part 115 of the connection 15 to the return 46 and closes it off from the part 215 of the connection 15.

The pressure sensor 24 detects the actual pressure in the reservoir 16 and sends a signal indicating this pressure to the control unit 22, which compares the actual pressure to the desired pressure; this control unit 22 triggers the control valve 54 as a function of a deviation between these pressures. The desired pressure in the reservoir can be variable depending on the operating parameters of the engine, for example the engine speed, load, and temperature. If the actual pressure in the reservoir 16 is lower than the desired pressure, then the control unit 22 brings the control valve 54 into its first switched position so that the fuel delivered by the high-pressure pump 14 travels into the reservoir 16. If the actual pressure is higher than the desired pressure, then the control unit 22 brings the control valve 54 into its second switched position so that the fuel delivered by the high-pressure pump 14 travels into the return 46. In the first exemplary embodiment, the pump pistons 34 of the two pump elements 30 deliver synchronously, i.e. each executes its intake stroke and its delivery stroke at the same time as the other. If it is necessary for the high-pressure pump 14 to deliver a large quantity of fuel to the reservoir 16, then the control unit 22 brings the control valve 54 into its first switched position at the end of the intake stroke of the pump pistons 34 of the pump elements 30, i.e. when they have reached their inner dead center. The control valve 54 remains in its first switched position during the entire delivery stroke of the pump pistons 34 of the pump elements 30 so that the entire fuel quantity delivered by the pump pistons 34 travels into the reservoir 16. If it is necessary for the high-pressure pump 14 to deliver no fuel to the reservoir 16, then the control unit 22 brings the control valve 54 into its second switched position at the end of the intake stroke of the pump pistons 34 of the pump elements 30, i.e. when they have reached their inner dead center, so that the entire fuel quantity delivered by the pump pistons 34 travels into the return 46. If it is necessary for a part of the fuel quantity delivered by the high-pressure pump 14 to travel into the reservoir 16, then the control unit 22 initially brings the control valve 54 into its second switched position when the pump pistons 34 are disposed at their inner dead center so that the fuel quantity delivered by the pump pistons 34 travels into the return 46. During the delivery stroke of the pump pistons 34, the control unit 22 brings the control valve 54 into its first switched position so that the fuel quantity, which is delivered by the pump pistons 34 up until the point at which they reach their outer dead center, travels into the reservoir 16. The greater the fuel quantity to be delivered to the reservoir 16 by the high-pressure pump 14, the earlier the control valve 54 is brought into its first switched position during the delivery stroke of the pump pistons 34.

Figure 2:
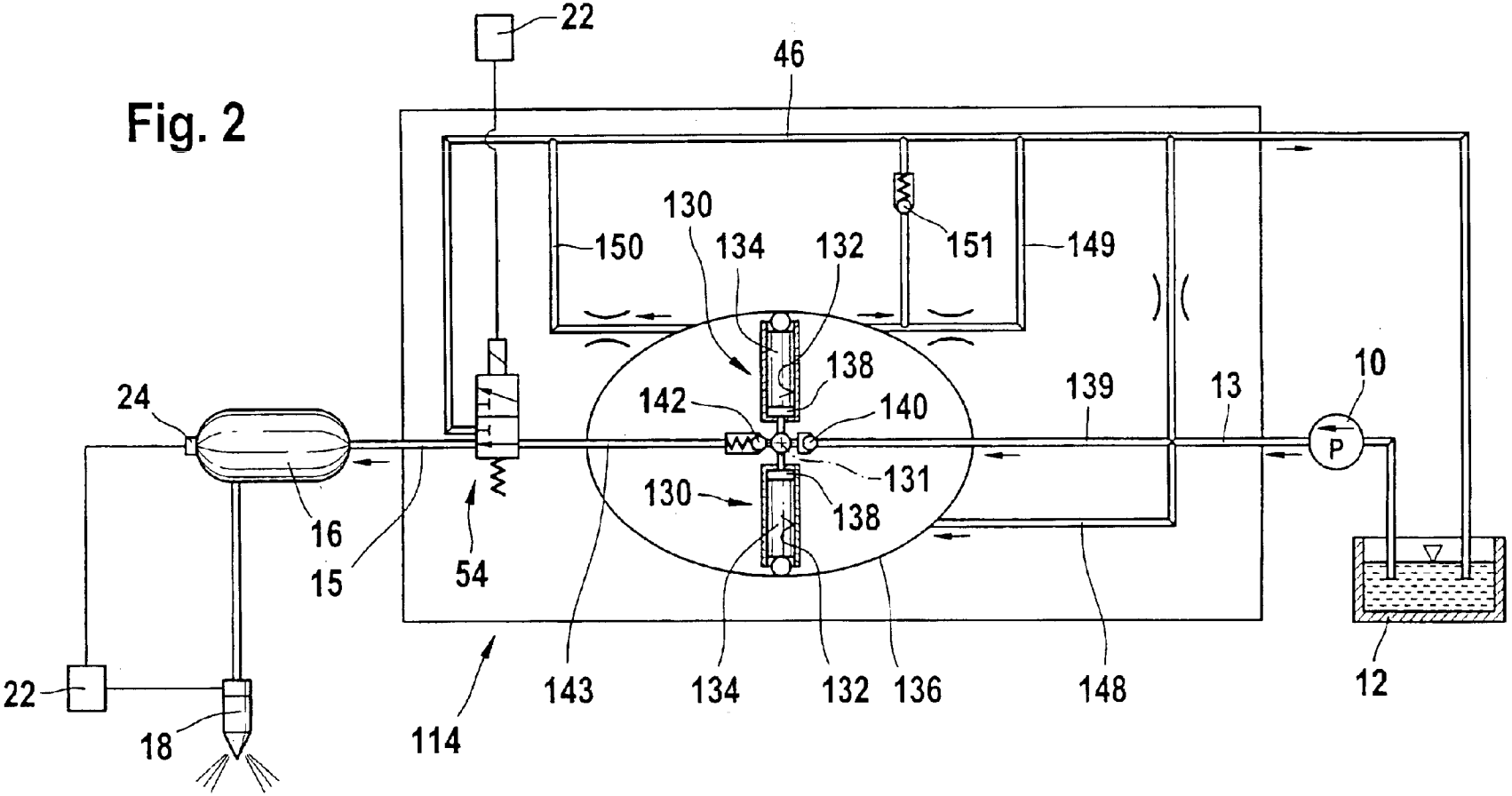
FIG. 2 shows the fuel injection device according to a second exemplary embodiment.

FIG. 2 shows the fuel injection device according to a second exemplary embodiment in which the design is essentially the same as that of the first exemplary embodiment, except that the high-pressure pump 114 has been modified. The high-pressure pump 114 in this instance has, for example, two pump elements 130 disposed diametrically opposite each other. The pump pistons 134 of the pump elements 130 are set into a stroke motion by a shared drive unit 136 that encompasses the pump elements 130; the drive unit 136 can, for example, be a cam drive unit or an eccentric drive unit. Each of the pump pistons 134 defines a pump working chamber 138 in the respective cylinder bore 132, in its region oriented toward the other pump bore. The pump working chambers 138 of the pump elements 130 are consequently oriented toward each other and connected to each other. The pump working chambers 138 are fed by shared supply line 139 from the connection 13 to the fuel-supply pump 10, with an inlet valve 140, which opens toward the pump working chambers 138. In addition, by means of an outlet valve 142, a pressure line 143 leads from the pump working chambers 138 to the connection 15 to the reservoir 16; the outlet valve 142 opens toward the reservoir 16. The pressure line 143 extends in the vicinity of the common axis 131 of the shared pump elements 130. When the pump pistons 134 move radially outward, they draw fuel into the pump working chambers 138 via the open inlet valve 140 while the outlet valve 142 is closed. When the pump pistons 134 move radially inward, they deliver highly pressurized fuel through the open outlet valve 142 into the pressure line 143 while the inlet valve 138 is closed. In this embodiment of the high-pressure pump 114, the volume of the pressure line 143 to the connection 15 of the high-pressure pump 115 to the reservoir 16 is less than in the embodiment of the high-pressure pump 14 according to the first exemplary embodiment, in which the pump elements 30 are provided with the separate pressure lines 40. As in the first exemplary embodiment, the fuel injection device according to the second exemplary embodiment is provided with the lubrication connection 148 for the drive unit 136 and with the pressure relief connections 149, 150 with the pressure relief valve 151.

Figure 3:
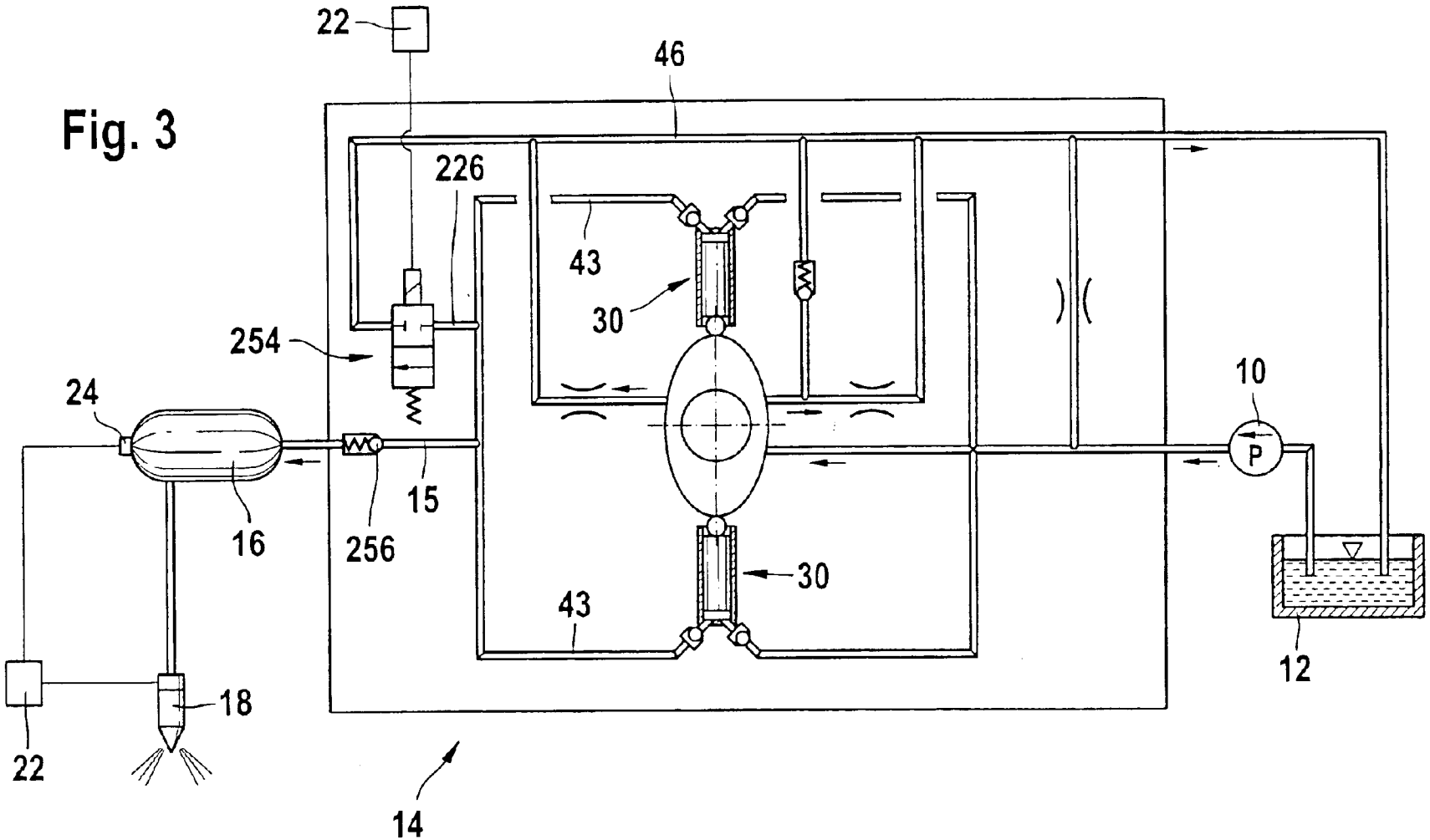
FIG. 3 shows the fuel injection device according to a third exemplary embodiment.

FIG. 3 shows the fuel injection device according to a third exemplary embodiment, in which the design is essentially the same as that of the first exemplary embodiment, except that the control valve 254 and its placement have been modified. The control valve 254 is embodied as a 2/2-way valve and controls a connection 226 of the pressure side of the high-pressure pump 14 to the return 46. The pressure side of the high-pressure pump 14 is connected to the reservoir 16 by means of the connection 15 into which the pressure lines 43 of the two pump elements 30 feed. The connection 15 contains a check valve 256 that opens toward the reservoir 16. The control unit 22 can switch the control valve 254 between two switched positions; in a first switched position, the control valve 254 opens the connection 226 of the pressure side of the high-pressure pump 14 to the return 46 and in a second switched position, the control valve 254 closes the connection 226 of the pressure side of the high-pressure pump 14 to the return 46. The check valve 256 is required in order to prevent fuel from flowing out of the reservoir 16 when the control valve 254 is in its first switched position in which the connection 226 is open between the pressure side of the high-pressure pump 14 and the return 46.

Figure 4:
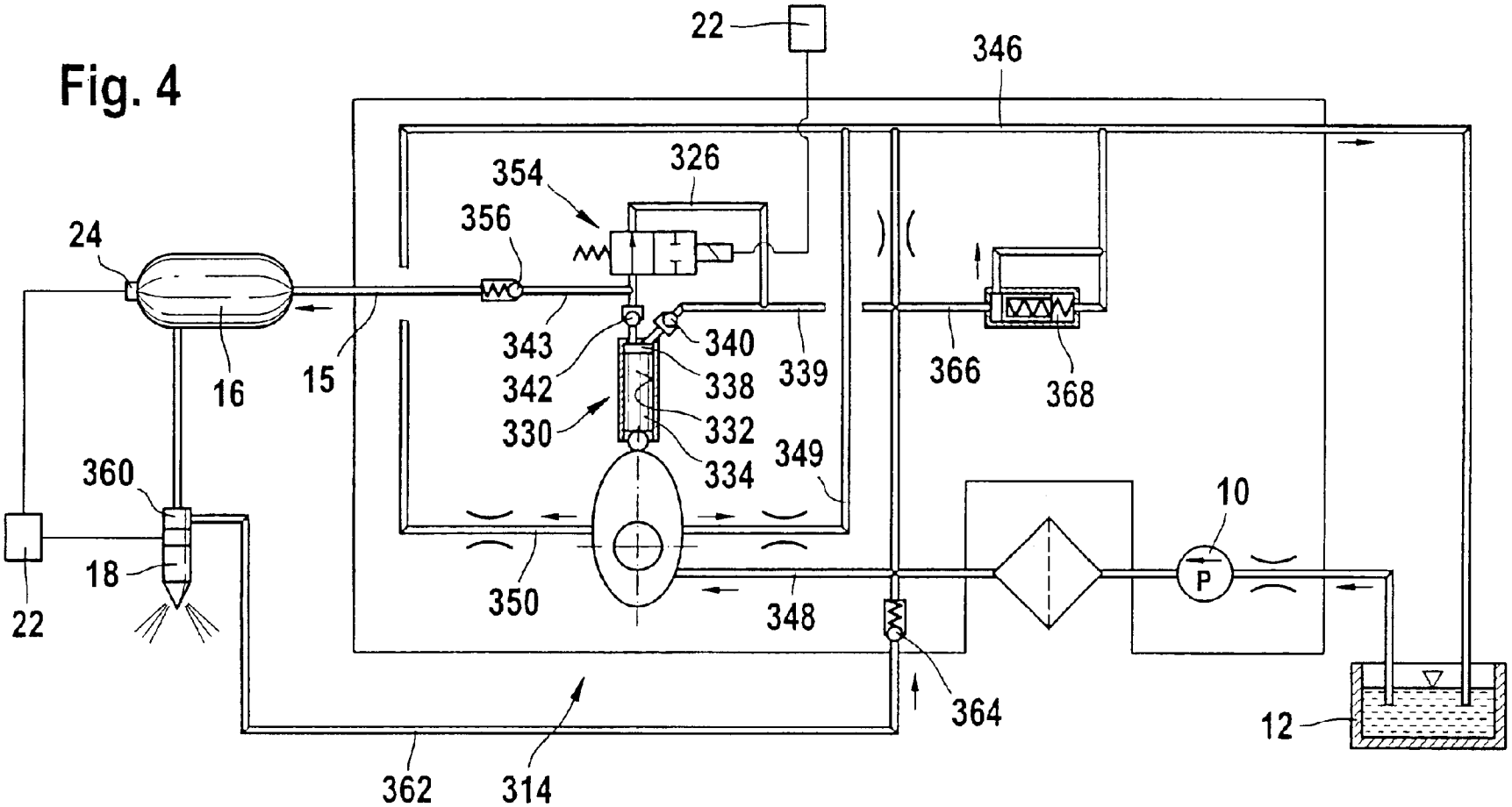
FIG. 4 shows the fuel injection device according to a fourth exemplary embodiment.

FIG. 4 shows the fuel injection device according to a fourth exemplary embodiment. In this instance, the high-pressure pump 314 has only one pump element 330 with a pump piston 334, which is guided in a cylinder bore 332, defines a pump working chamber 338, and is set into a stroke motion by a drive unit 336. A supply line 339 from the fuel-supply pump 10 feeds into the pump working chamber 338 via an inlet valve 340. From the pump working chamber 338, an outlet valve 342 leads to a pressure line 343 to the connection 15 to the reservoir 16. The connection 15 contains a check valve 356, which opens toward the reservoir 16. A connection 326, which contains a control valve 354, leads from the pressure side of the high-pressure pump 314 and feeds into the supply line 339. The control valve 354 is embodied as a 2/2-way valve and can be switched between two switched positions by a control unit 22. In a first switched position, the control valve 354 opens the connection 326 so that fuel delivered by the high-pressure pump 314 is returned to its suction side, and in a second switched position, the control valve 354 closes the connection 326 so that fuel delivered by the high-pressure pump 314 travels into the reservoir 16. The control valve 354 is embodied in such a way that when it is not activated, it assumes its open first switched position in which the connection 326 is open, and when it is activated, it assumes its closed second switched position in which the connection 326 is closed. A lubrication connection 348 for the drive unit 336 can branch off from the supply line 339; pressure relief lines 349, 350, which feed into the return 346, can also branch off from the drive unit 336.

In the fuel injection device according to the fourth exemplary embodiment, a pressure-boosting device 360 is also provided between the reservoir 16 and the injectors 18; this device increases the pressure prevailing in the reservoir 16 so that the fuel injection at the injectors 18 occurs at a higher pressure. It is possible for each of the injectors 18 to be provided with its own pressure-boosting device 360, which can also be integrated into the injector 18. By contrast with the exemplary embodiments explained above, this only requires the high-pressure pump 314 to produce a comparatively low pressure. A connection 362, which diverts unneeded fuel, leads away from pressure-boosting device 360. The connection feeds into the supply line 339 at a point between the fuel-supply pump 10 and the suction side of the high-pressure pump 314. The connection 362 contains a check valve 364, which opens toward the supply line 339. A connection 366 to the return 346, which contains a pressure relief valve 368, also branches off from the supply line 339. The pressure relief valve 368 limits the pressure on the suction side of the high-pressure pump 314.

Figure 5:
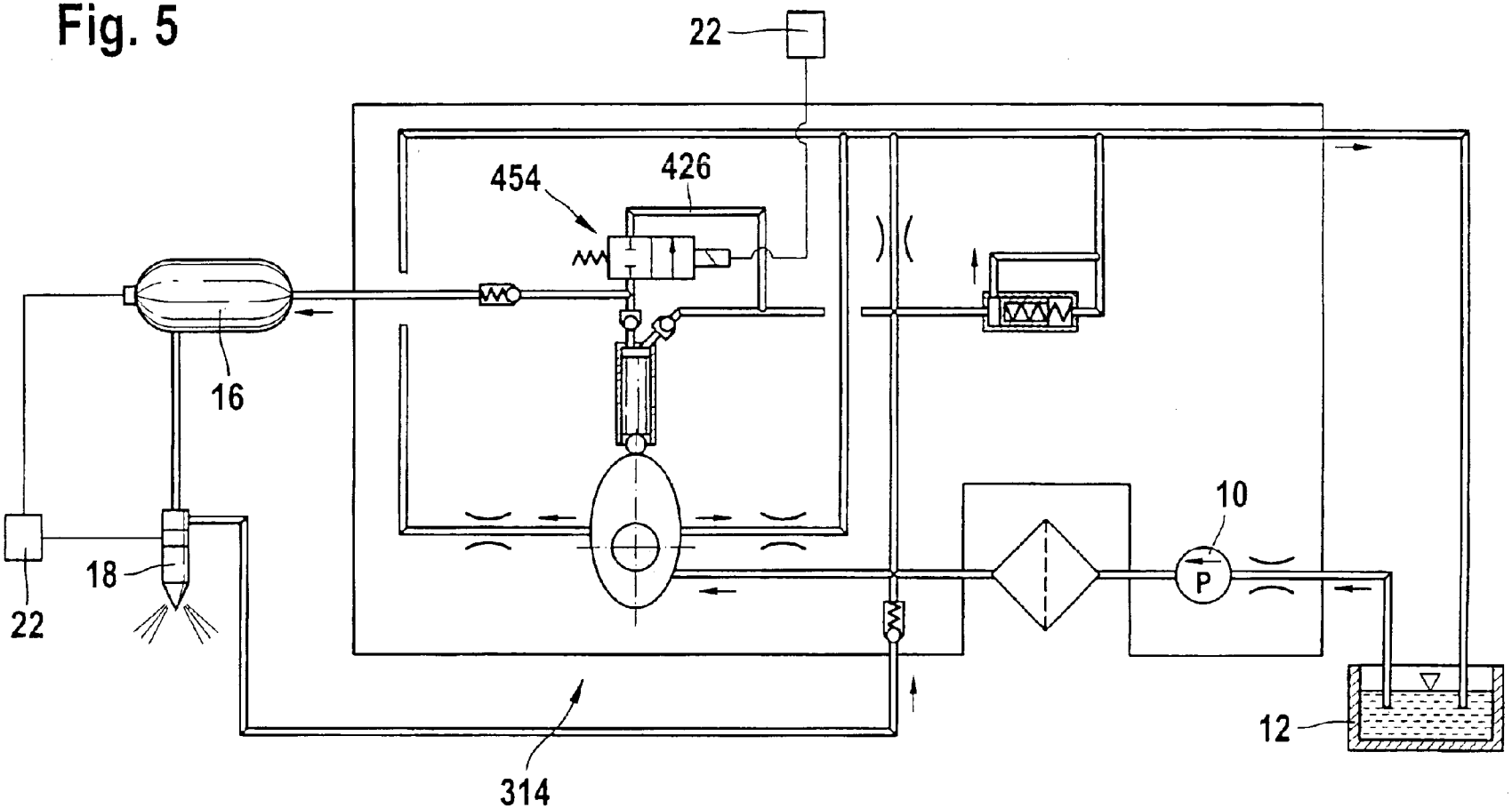
FIG. 5 shows the fuel injection device according to a fifth exemplary embodiment.

FIG. 5 shows the fuel injection device according to a fifth exemplary embodiment, which is modified in relation to the fourth exemplary embodiment only with regard to the control valve 454. The control valve 454 is designed so that when it is not activated, it assumes a closed switched position in which the connection 426 is closed, and when it is activated, it assumes an open switched position in which the connection 426 is open. If the control valve 454 can no longer be triggered due to a malfunction, then fuel can still be delivered to the reservoir 16 so that it remains possible to operate the engine.

Figure 6:
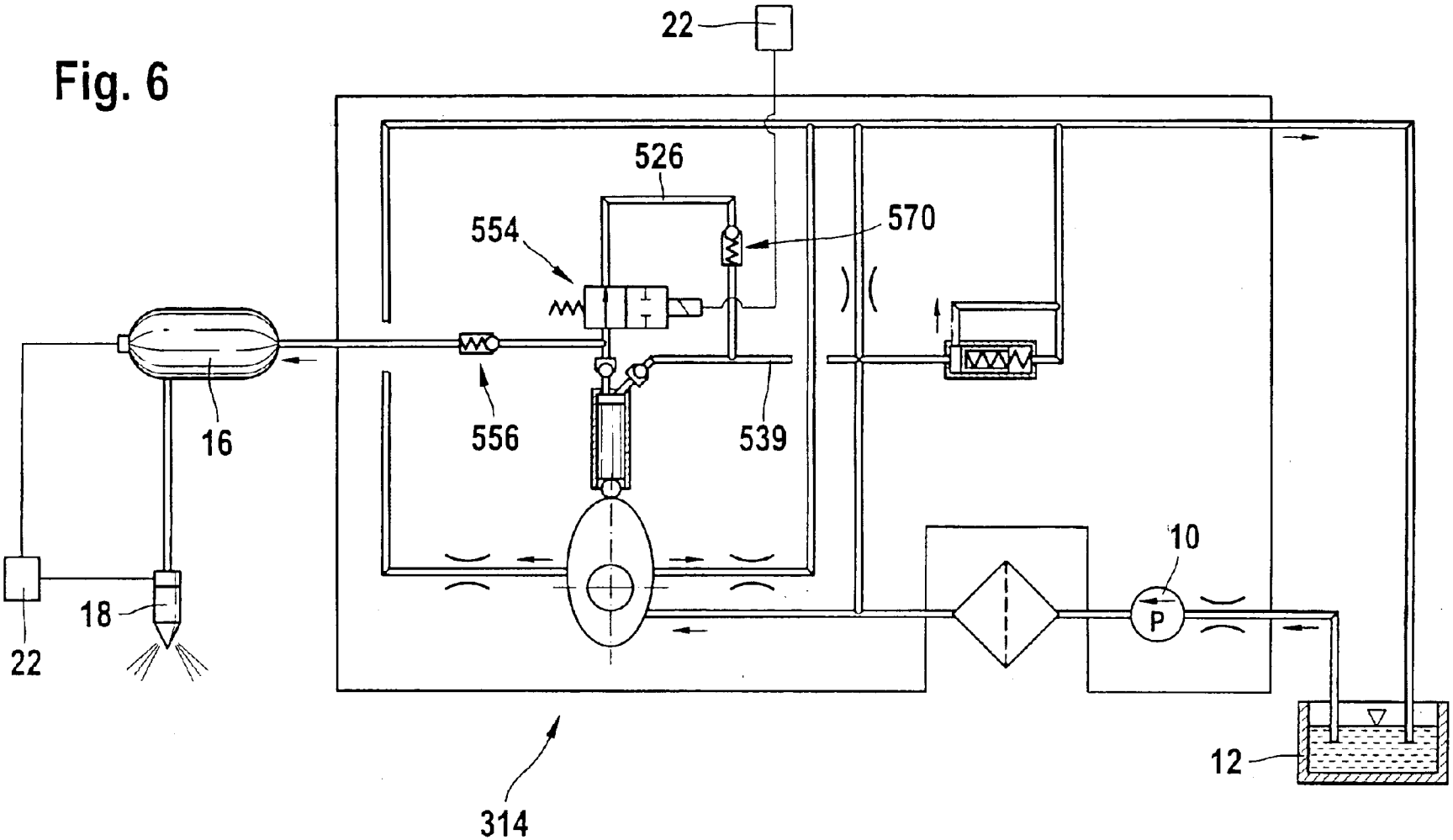
FIG. 6 shows the fuel injection device according to a sixth exemplary embodiment.

FIG. 6 shows the fuel injection device according to a sixth exemplary embodiment, which has essentially the same design as the fourth exemplary embodiment except that the connection 526 controlled by the control valve 554 contains a check valve 570, which opens toward the supply line 539. The check valve 570 can be disposed downstream of the control valve 554. The control valve 554 is designed so that when it is not activated, it assumes its open switched position in which the connection 526 is open, and when it is activated, it assumes its closed switched position in which the connection 526 is closed. The opening pressure of the check valve 570 is higher than the opening pressure of the check valve 556 to the reservoir 16. If the control valve 554 can no longer be triggered due to a malfunction, then it remains continuously in its open switched position. If the pressure in the reservoir 16 has fallen to a point below the opening pressure of the check valve 570, then the check valve 570 closes so that the connection 526 is closed and fuel travels through the open check valve 556 into the reservoir 16. This allows a minimum pressure to be maintained in the reservoir 16, which permits an emergency operation of the engine. In this instance, the opening pressure of the check valve 570 determines the minimum pressure in the reservoir 16.

Figure 7:
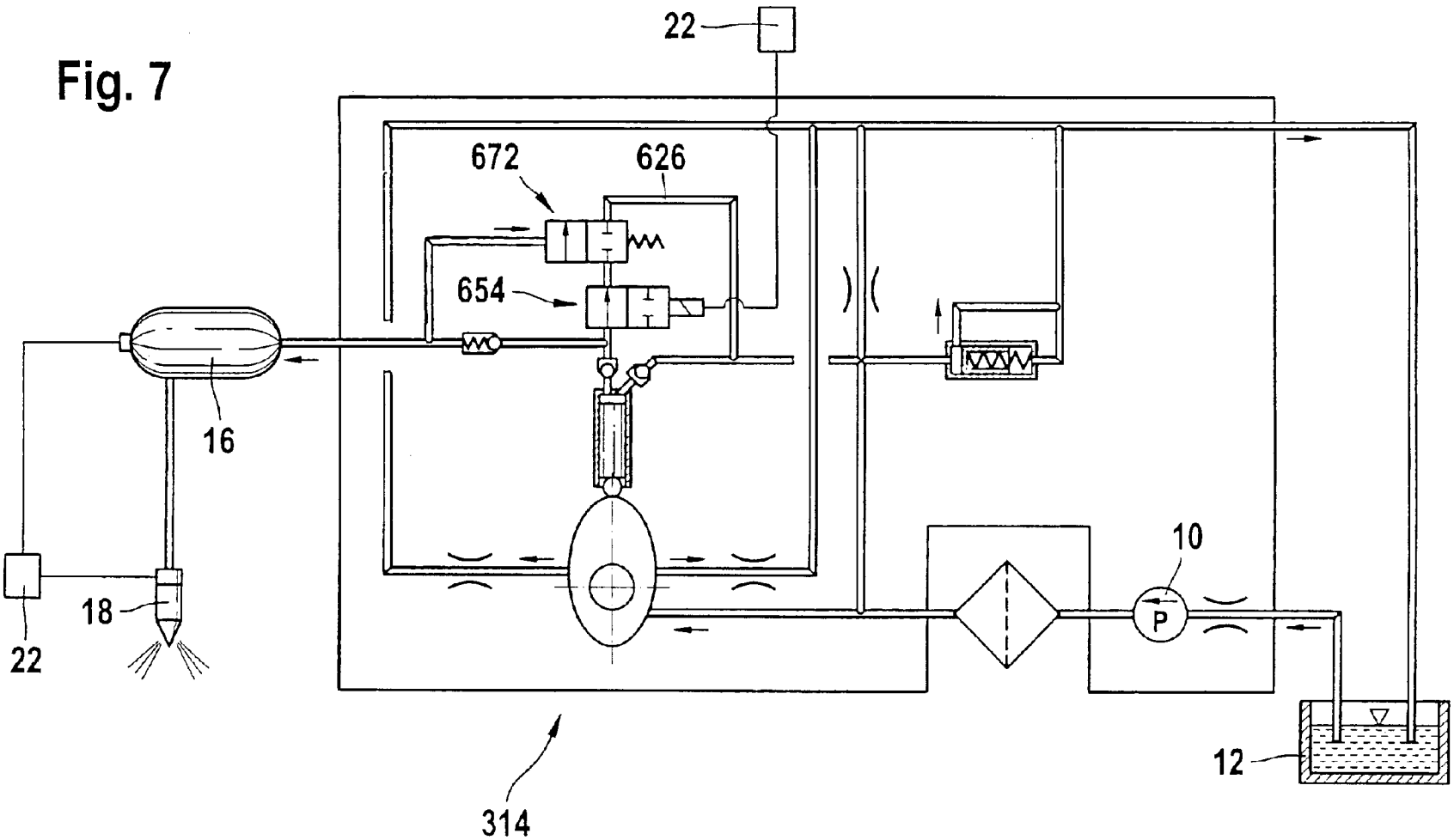
FIG. 7 shows the fuel injection device according to a seventh exemplary embodiment.

FIG. 7 shows the fuel injection device according to a seventh exemplary embodiment, which once again has the same design as the fourth exemplary embodiment except that the connection 626 contains another valve 672, which controls the connection 626. The valve 672 is situated downstream of the control valve 654 in the connection 626 and the valve 672 is controlled by the pressure prevailing in the reservoir 16. The valve 672 can, for example, be embodied as a 2/2-way valve or as a continuously variable valve. If the pressure in the reservoir 16 is high, then the valve 672 assumes an open switched position in which the connection 626 is open. If the pressure in the reservoir 16 is low, then the valve 672 assumes a closed switched position in which the connection 626 is closed. The control valve 654 is designed so that when it is not activated, it assumes its open switched position in which the connection 626 is open, and when it is activated, it assumes its closed switched position in which the connection 626 is closed. If the control valve 654 can be triggered properly, then the pressure in the reservoir 16 is high even when the valve is not activated so that the valve 672 assumes its closed switched position and the connection 626 is continuously open. If there is a malfunction of the control valve 654, then it continuously assumes its open switched position, which causes the pressure in the reservoir 16 to decrease anyway. If the pressure in the reservoir 16 has fallen to a minimum pressure, then the valve 672 is brought into its closed switched position so that the connection 626 is closed and fuel is delivered to the reservoir 16. This permits an emergency operation of the engine. The minimum pressure in the reservoir 16 here is determined by the design of the valve 672, i.e. by the pressure in the reservoir 16 at which the valve 672 closes.

The embodiments of the fuel injection device according to the above-explained exemplary embodiments can be combined with one another in arbitrary fashion. A pressure-boosting device like the one provided in the fourth exemplary embodiment can thus be provided in all of the exemplary embodiments, and a return is routed from this pressure-boosting device to the suction side of the high-pressure pump. The high-pressure pump does not have to have only one or two pump elements, but can have an arbitrary number of pump elements. In the fuel injection device according to the above-described exemplary embodiments, the pump working chambers of the pump elements are always completely filled during the intake stroke of the pump pistons, even if the high-pressure pump delivers little or no fuel to the reservoir. The pump elements are consequently sufficiently cooled, even in the event of a zero delivery or a partial delivery, and no cavitation occurs. The inlet valves into the pump working chambers of the pump elements can be adjusted so that they open even at a low pressure, which keeps the requirements for uniformity in the pressure generation by the fuel-supply pump 10 to a minimum and allows the high-pressure pump to generate pressure more rapidly during the starting of the engine. In a simple manner, the control valve assures that when necessary, the high-pressure pump does not deliver any fuel to the reservoir.

The foregoing relates to preferred exemplary embodiments of the invention, it being understood that other variants and embodiments thereof are possible within the spirit and scope of the invention, the latter being defined by the appended claims.

We claim:

1. A fuel injection device for an internal combustion engine, the device comprising a high-pressure pump (14; 114; 314) that supplies fuel to a reservoir (16) connected to injectors (18) disposed in the cylinders of the engine, a fuel-supply pump (10) that delivers fuel from a fuel tank (12) to the suction side of the high-pressure pump (14; 114; 314), an electrically actuated control valve (54; 254; 354; 454; 554; 654) for adjusting the quantity of fuel that the high-pressure pump (14; 114; 314) delivers to the reservoir (16), the control valve (54; 254; 354; 454; 554; 654) being disposed on the pressure side of the high-pressure pump (14; 114; 314), and means for switching the control valve (54; 254; 354; 454; 554; 654) between a first switched position, in which the pressure side of the high-pressure pump (14; 114; 314) is closed off from a pressure relief region, and a second switched position, in which the pressure side of the high-pressure pump (14; 114; 314) is connected to the pressure relief region, wherein the control valve (54) is embodied as a 3/2-way valve, which, in a first switched position, connects the pressure side of the high-pressure pump (14) to the reservoir (16) and closes it off from the pressure relief region, and in a second switched position, connects the pressure side of the high-pressure pump (14) to the pressure relief region and closes it off from the reservoir (16).

2. The fuel injection device according to claim 1, wherein the pressure relief region comprises a return (46; 346), which leads at least indirectly into the fuel tank (12) or to the suction side of the fuel-supply pump (10).

3. The fuel injection device according to claim 1, wherein the pressure relief region is the suction side of the high-pressure pump (314).

4. A fuel infection device for an internal combustion engine, the device comprising a high-pressure pump (14; 114; 314) that supplies fuel to a reservoir (16) connected to injectors (18) disposed in the cylinders of the engine, a fuel-supply pump (10) that delivers fuel from a fuel tank (12) to the suction side of the high-pressure pump (14; 114; 314), an electrically actuated control valve (54; 254; 354; 454; 554; 654) for adjusting the quantity of fuel that the high-pressure pump (14; 114; 314) delivers to the reservoir (16), the control valve (54; 254; 354; 454; 554; 654) being disposed on the pressure side of the high-pressure pump (14; 114; 314), and means for switching the control valve (54; 254; 354; 454; 554; 654) between a first switched position, in which the pressure side of the high-pressure pump (14; 114; 314) is closed off from a pressure relief region, and a second switched position, in which the pressure side of the high-pressure pump (14; 114; 314) is connected to the pressure relief region, wherein the high-pressure pump (114) comprises a number of pump elements (130) disposed distributed uniformly around a common axis (131), each said pump element having a pump piston (134) guided in a cylinder bore (132) to define a pump working chamber (138), and is set into a stroke motion, the pump working chambers (138) of the pump elements (130) being disposed opposite one another, oriented toward the common axis (131), and a connection (15) from the pressure side of the high-pressure pump (114) to the reservoir (16).

5. The fuel injection device according to claim 1, wherein the high-pressure pump (114) comprises a number of pump elements (130) disposed distributed uniformly around a common axis (131), each said pump element having a pump piston (134) guided in a cylinder bore (132) define a pump working chamber (138), and is set into a stroke motion, the pump working chambers (138) of the pump elements (130) being disposed opposite one another, oriented toward the common axis (131), and a connection (15) from the pressure side of the high-pressure pump (114) to the reservoir (16).

6. The fuel injection device according to claim 1, wherein, when not activated, the control valve assumes its first switched position in which the pressure side of the high-pressure pump (314) is closed off from the pressure relief region, and when activated, the control valve assumes its second switched position in which the pressure side of the high-pressure pump (314) is connected to the pressure relief region.

7. The fuel injection device according to claim 4, wherein, when not activated, the control valve assumes its first switched position in which the pressure side of the high-pressure pump (314) is closed off from the pressure relief region, and when activated, the control valve assumes its second switched position in which the pressure side of the high-pressure pump (314) is connected to the pressure relief region.

8. The fuel injection device according to claim 1, further comprising a check valve (570), which opens toward the pressure relief region and is connected in series with the control valve (554).

9. The fuel injection device according to claim 4, further comprising a check valve (570), which opens toward the pressure relief region and is connected in series with the control valve (554).

10. The fuel injection device according to claim 6, further comprising a check valve (570), which opens toward the pressure relief region and is connected in series with the control valve (554).

11. A fuel injection device for an internal combustion engine, the device comprising a high-pressure pump (14; 114; 314) that supplies fuel to a reservoir (16) connected to injectors (18) disposed in the cylinders of the engine, a fuel-supply pump (10) that delivers fuel from a fuel tank (12) to the suction side of the high-pressure pump (14; 114; 314), an electrically actuated control valve (54; 254; 354; 454; 554; 654) for adjusting the quantity of fuel that the high-pressure pump (14; 114; 314) delivers to the reservoir (16), the control valve (54; 254; 354; 454; 554; 654) being disposed on the pressure side of the high-pressure pump (14; 114; 314), and means for switching the control valve (54; 254; 354; 454; 554; 654) between a first switched position, in which the pressure side of the high-pressure pump (14; 114; 314) is closed off from a pressure relief region, and a second switched position, in which the pressure side of the high-pressure pump (14; 114; 314) is connected to the pressure relief region, further comprising an additional valve (672) controlled by the pressure prevailing in the reservoir (16) and connected in series with the control valve (654), the additional valve (672) assuming a first open switched position when there is high pressure in the reservoir (16) to open the connection (626) of the pressure side of the high-pressure pump (314) to the pressure relief region, and a second closed position when there is low pressure in the reservoir (16) to close the connection (626) of the pressure side of the high-pressure pump (314) to the pressure relief region.

12. The fuel injection device according to claim 1, further comprising a check valve (256; 356; 556) in the connection (15) between the pressure side of the high-pressure pump (214; 314) and the reservoir (16), the check valve (256; 356; 556) opening toward the reservoir (16).

13. A fuel injection device as recited in claim 4, wherein the connection branches off in the vicinity of the common axis (131).

14. A fuel injection device as recited in claim 5, wherein the connection branches off in the vicinity of the common axis (131).

* * * * *